United States Patent [19]

Fiore et al.

[11] 4,428,458

[45] Jan. 31, 1984

[54] FOLDABLE LADDER

[75] Inventors: Joseph Fiore, New Rochelle, N.Y.; Louis S. Hoffman, Morristown, N.J.

[73] Assignee: Turbo Inc., Morristown, N.J.

[21] Appl. No.: 267,863

[22] Filed: May 28, 1981

[51] Int. Cl.[3] ..... E06C 1/28

[52] U.S. Cl. ..... 182/116; 182/162; 182/163; 182/129; 182/176

[58] Field of Search ..... 182/159–167, 182/129, 176, 24, 16, 116, 117

[56] References Cited

U.S. PATENT DOCUMENTS

| | | | |
|---|---|---|---|
| 130,929 | 8/1872 | Mattern | 182/159 |
| 292,041 | 1/1884 | Page | 182/176 |
| 958,732 | 5/1910 | Dennis | 182/160 |
| 988,086 | 3/1911 | Garraway | 182/160 |
| 1,054,108 | 2/1913 | Garraway | 182/162 |
| 1,108,896 | 9/1914 | Garraway | 182/162 |
| 1,165,588 | 12/1915 | Garraway | 182/160 |
| 1,514,569 | 11/1924 | Pettes | 182/161 |
| 1,772,213 | 8/1930 | Francois | 182/162 |
| 2,088,878 | 8/1937 | Stogner | 182/162 |
| 2,670,120 | 2/1954 | Sanguineti | 182/160 |

*Primary Examiner*—Reinaldo P. Machado

*Attorney, Agent, or Firm*—Caesar, Rivise, Bernstein & Cohen, Ltd.

[57] ABSTRACT

A foldable ladder of the type having laterally spaced-apart, substantially vertically oriented front side rails joined by a plurality of steps. A rear support, preferably in the form of laterally spaced-apart, vertically oriented legs, are movable away from the side rails to open the ladder and movable toward the side rails to close the ladder. The side rails and rear legs include hinges intermediate vertical ends thereof for permitting vertical collapsing of the ladder by the folding of the side rails and rear legs about their respective hinges. A storage container, which also doubles as an article support when the ladder is used, also forms a part of the instant invention.

10 Claims, 10 Drawing Figures

FOLDABLE LADDER

FIELD OF THE INVENTION

This invention relates to a foldable ladder, and more specifically to a foldable ladder capable of being collapsed into an extremely compact construction.

DESCRIPTION OF THE PRIOR ART

Inadequate storage space is becoming a problem of increasing concern. This is caused in part by the desire and need to keep down the cost of new housing construction. In order to achieve this result it is quite common to build new housing without areas, such as basements and garages, that conventionally have been used, at least in part, for storage purposes. Moreover, there is a general interest in today's society to not be wasteful, and this interest carries over into the area of managing storage space. One way in which storage space is managed effectively is by purchasing the most compact items for the desired purpose or result.

A stepladder is one item that many homeowners, or renters consider essential. In most households a stepladder is only used infrequently, and most of the time must be maintained in some storage area.

An effort has been made in the past to design compact stepladder constructions. Specifically, in addition to designing a folding stepladder so that it can be folded in a conventional manner (i.e. by bringing the front and rear legs together), it has been suggested to include hinged, sectional steps to permit the uprights of the ladder to be collapsed laterally. This technique for establishing a compact ladder construction is suggested in U.S. Pat. Nos. 130,929 (Mattern); 958,732 (Dennis); 988,086 (Garraway); 1,054,108 (Garraway); 1,108,896 (Garraway); 1,165,588 (Garraway); 1,514,569 (Pettes); 2,088,878 (Stogner) and 2,670,120 (Stanguineti).

Although the above prior art ladder constructions do aid in establishing a compact arrangement, a need for improvement still exists, and is always welcomed.

DESCRIPTION OF THE INVENTION

This invention relates to a foldable ladder of the type having laterally spaced-apart front side rails joined by a plurality of steps, and rear support means movable away from the side rails when the ladder is to be opened for use, and movable toward the front side rails when the ladder is to be closed for storage; characterized in that the side rails and rear support means include hinge means intermediate vertical ends thereof for permitting vertical collapsing of the ladder by the folding of the side rails and rear support means about said intermediate hinge means.

Reference throughout this application to the orientation of elements in the ladder refers to that orientation which exists when the ladder is positioned for use.

As a result of the vertical collapsability of the foldable ladder of this invention, an extremely compact construction can be achieved in a manner which has not been suggested in the prior art.

In the most preferred embodiment of this invention the steps are formed of hinged sections to permit the uprights of the ladder to be laterally collapsed, i.e. the laterally spaced-apart side rails can be moved toward each other. When the rear support means is formed by laterally spaced-apart legs, such legs also can be laterally collapsed by movement toward each other.

From the above explanation it should be apparent that the most preferred ladder in accordance with this invention can be folded, or collapsed in three mutually perpendicular directions. First, the ladder can be closed in a conventional manner, by bringing the rear support means close to the front side rails. Secondly, the ladder can be laterally collapsed by moving the side rails toward each other, and by moving the rear legs, if such are employed, toward each other. Thirdly, the ladder can be vertically collapsed as a result of the unique hinge construction intermediate the upper and lower ends of the substantially vertically oriented upright members of the ladder.

In the preferred embodiment of this invention the hinge means intermediate the vertical ends of the uprights are designed to permit the lower sections of these uprights to pivot only in one direction into a closed, or folded condition. Movement in the opposite direction will cease when the uprights are substantially linear, which is the position they are required to assume when the ladder is intended to be used.

For certain ladder constructions it may be necessary to spread, or separate the rear support means from the front rails to a greater extent than in the normally opened condition of the ladder, in order to permit the lower sections of the uprights to be swung in an arcuate path into a folded position against the upper sections of the uprights.

In the preferred embodiment of this invention a side brace including interconnected links movable relative to each other joins a side rail to its adjacent rear supporting leg. The interconnected links of this brace are movable to a fully extended position, in which the rear legs are spaced farther apart from the front side rails than when the ladder is intended to be used. These interconnected links can move relative to each other into a contracted position, in which the rear legs are closely adjacent the front side rails for storage of the ladder. In addition, the interconnected links of the side brace include cooperable locking means for preventing relative movement of the links when they are intermediate their fully extended position and their contracted position. This latter position of the links maintains the desired spacing between the front rails and rear legs when the ladder is intended to be used. If the interconnected links were not capable of locking in this intermediate position, it would be necessary to maintain the links in their fully extended position; thereby unnecessarily reducing the effective height of the ladder.

In the most preferred embodiment of this invention a storage container is provided for the vertically and laterally collapsed ladder, and this storage container also is adapted to function as a platform, or article support when the ladder is opened for use. Most preferably the storage container has an internal compartment formed by a bottom wall joined to upstanding peripheral front, rear and side walls. The compartment is opened at the top for receiving the lower end of the ladder. When the ladder is vertically collapsed, the hinged junction of the sections of one step constitutes the lowermost region of the ladder, and will prevent the ladder from being flat on the bottom and standing alone. Therefore, in the preferred construction of the storage container, spaced-apart partitions are provided to extend above the bottom wall of the compartment for engaging and supporting the ladder with the hinged junction of the sections of said one step disposed between said spaced-apart partitions and out of engagement with the bottom wall. This arrangement provides a stand, a platform and protection for the hinged junction.

In the most preferred embodiment of this invention cooperable attachments are provided on the storage container and the ladder for permitting the container to be removably attached to the ladder with the front and rear walls of said container disposed in a substantially horizontal plane. Most preferably one of the front and rear walls extends beyond the other wall to provide a support for tools, paint, etc. when the ladder is being utilized.

Most preferably the foldable ladder also includes a sectional upper, or top platform that is hinged intermediate its lateral ends. Upper ends of the laterally spaced-apart side rails and rear support means are pivotally connected adjacent the lateral ends of the upper platform for permitting lateral relative movement of the side rails and rear support means toward and away from each other. It is desirable to include openings through the upper platform on opposite sides of the intermediate hinge connection, and to position the openings so that they will be laterally aligned with each other when the ladder has been laterally collapsed. These laterally aligned openings provide a carrying handle for the collapsed construction.

Other objects and advantages of this invention will become apparent by referring to the Description of the Preferred Embodiments of the Invention which follows, taken in conjunction with the accompanying drawings.

DESCRIPTION OF THE PREFERRED EMBODIMENTS OF THE INVENTION

Figure 1:
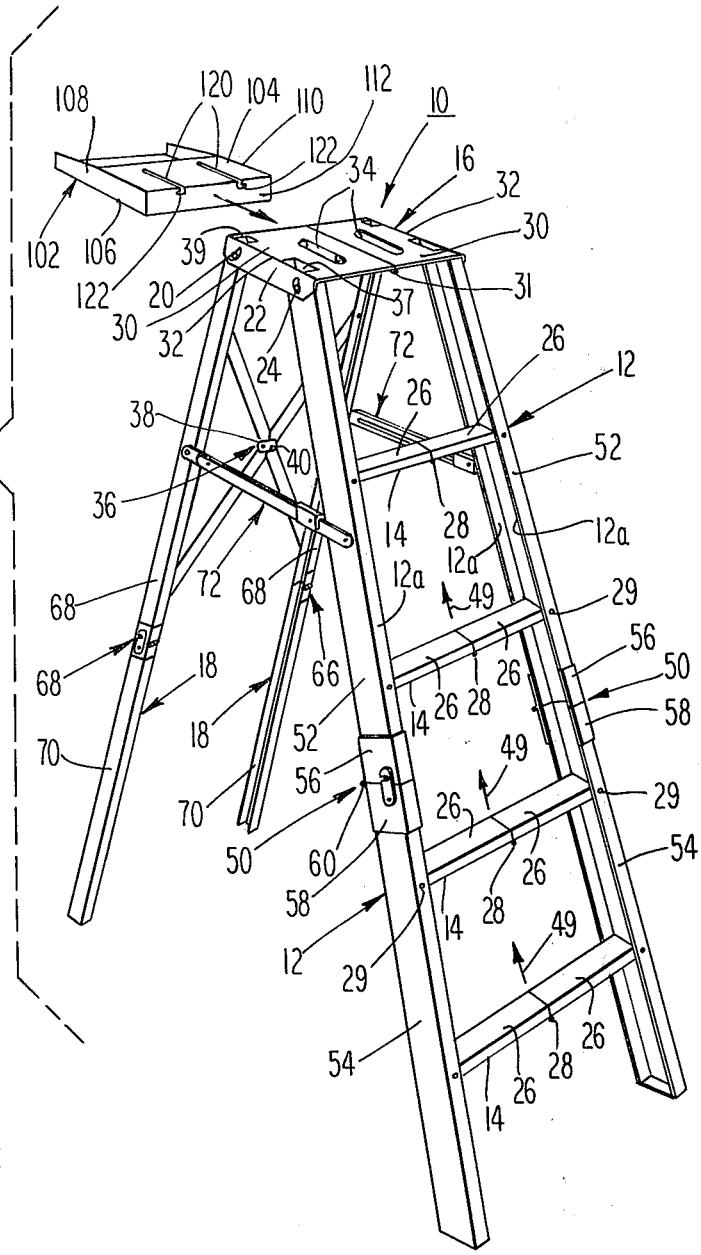
FIG. 1 is a perspective view of the foldable ladder of this invention with an article holding and storage container thereof being shown separated therefrom.

Referring to FIG. 1, a folding stepladder 10 in accordance with this invention includes a pair of front side rails 12 to which hinged, sectional steps 14 are secured. In the most preferred embodiments of this invention a hinged sectional top platform 16 also is provided; details of which will be described later in this application.

The folding stepladder includes a rear support means, preferably in the form of a pair or rear supporting legs 18. Each of the legs is connected through a pivot pin 20 (only one being shown in FIG. 1) adjacent the rear end of a downturned side apron 22 of the platform 16. A pivot pin 24 (only one being shown in FIG. 1) likewise connects the upper end of each front side rail 12 to the front of the downturned aprons 22.

The pivotal connection among the top platform 16, the front side rails 12 and the rear legs 18 permits the required relative movement between the front rails and side legs to open the ladder for use, as shown in FIG. 1, or to close the ladder for storage in a conventional manner.

Each of the steps 14 interconnecting the side rails 12 includes adjacent sections 26 hinged together through a pivot pin 28. Each section 26 is likewise hinged to inturned flanges 12*a* of its adjacent rail 12 by a pivot pin 29 disposed at an acute angle to the upper surface of the step. This permits the upper surface of the step to be positioned in a generally horizontal plane when the ladder is opened for use, with the side rails 12 being at an angle to the horizontal, and to permit each step section 26 to be collapsed between the inturned flanges 12*a* of its adjacent rail 12 when the ladder 10 is laterally collapsed, as illustrated in FIGS. 2 and 3.

Figure 1B:
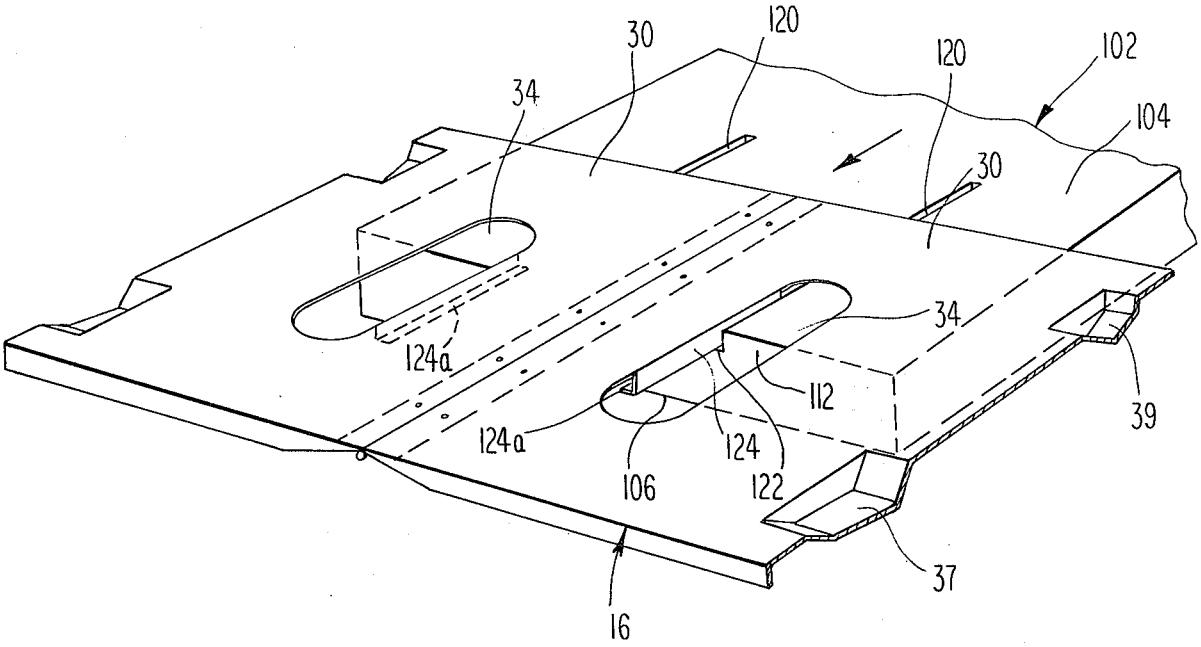
FIG. 1*b* is an enlarged perspective view of the top platform of the ladder with the article holding and storage container partially assembled therewith.
Figure 1A:
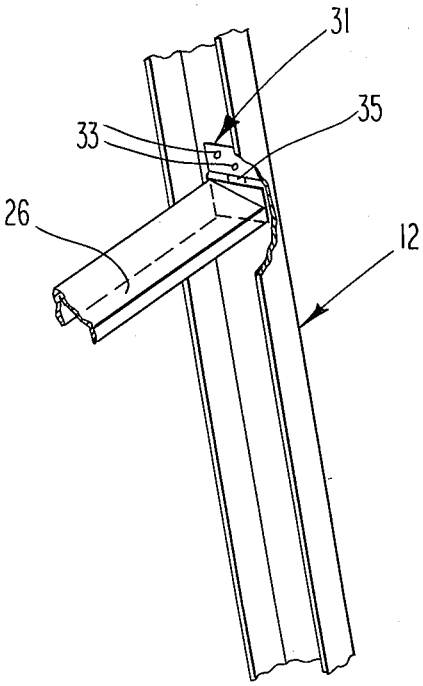
FIG. 1*a* is a fragmentary perspective view of an alternate arrangement for hinging the steps to the side rails of the ladder.
Figure 1C:
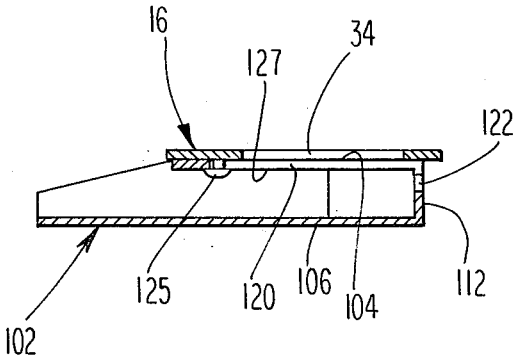
FIG. 1*c* is a sectional view showing an alternate arrangement for attaching the article holding and storage container to the top platform ladder.

Referring to FIG. 1*a*, an alternate arrangement for hinging the step sections 26 to the side rails 12 is illustrated. Specifically, an upper section of hinge member 31 is secured by suitable fasteners 33, such as bolts or rivets, to the base of a U-shaped side rail 12. The end of step section 26 is then bolted to the lower section of the hinge member 31, with the upper surface of said step section disposed at an acute angle to hinge joint 35.

The specific manner in which the step sections 26 of each step 14 are hinged to each other and to the side rails is not considered to be limiting on the present invention; several alternative techniques being disclosed in the prior art patents referenced earlier in this application, and incorporated herein by reference.

Figure 2:
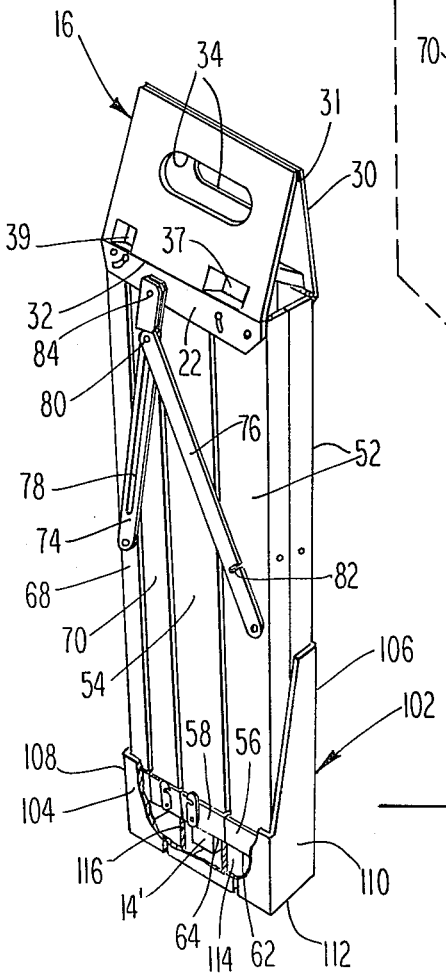
FIG. 2 is a perspective view of the ladder illustrated in FIG. 1, but showing it in its completely collapsed condition, and with the storage container partially broken away to show specific details of construction.
Figure 3:
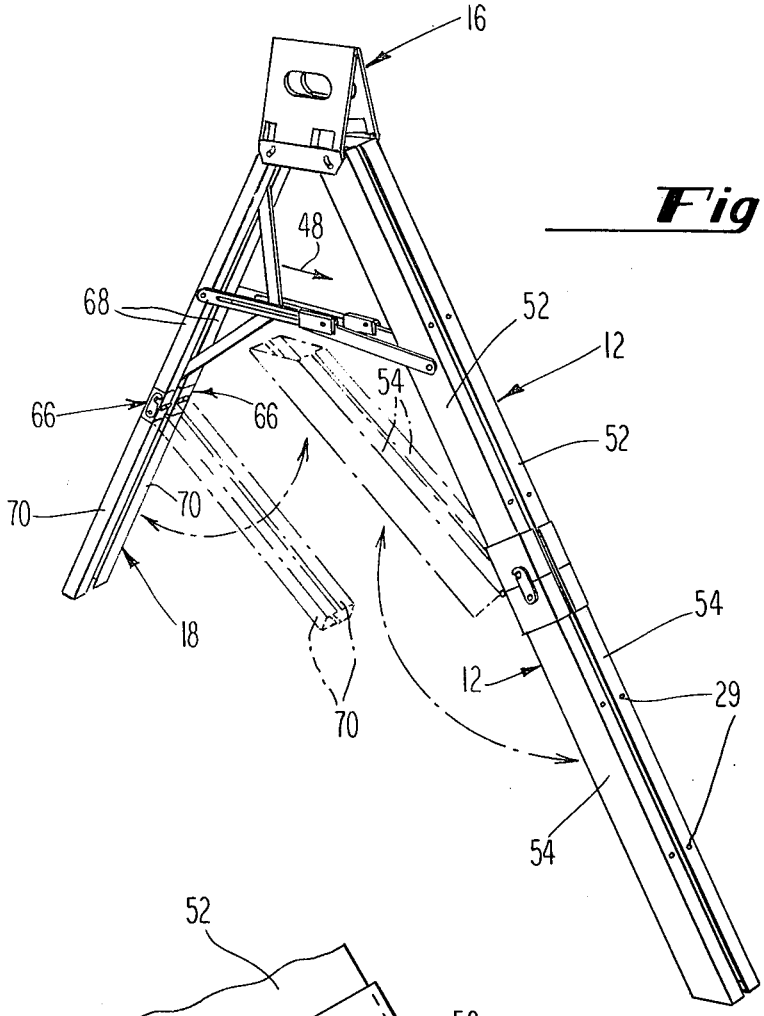
FIG. 3 is a perspective view of the ladder in its fully extended condition, after it has been laterally collapsed, to permit the rails and legs thereof to be vertically collapsed, and showing a partially collapsed, or folded position of these rails and legs in phantom representation.

Referring to FIGS. 1 and 2, the top platform 16 includes two sections 30 hinged to each other at 31 intermediate the sides of said ladder. A hinged connection 32 also is established between each top section 30 and its adjacent apron 22 to permit the platform 16 to collapse, along with the steps 14, when the ladder is laterally collapsed into the condition shown in FIG. 2. In addition, each top section 30 has downwardly directed tabs 37 and 39 adjacent its respective apron 22, and these tabs aid in stabilizing the ladder when it is in use by being received within the U-shaped channels of the front rails 12 and the rear legs 18.

An elongate opening 34 is provided in each of the top sections 30 of the platform 16, and these openings are suitably positioned so that they will be laterally aligned with each other when the ladder is laterally collapsed, to thereby provide a carrying handle (FIG. 2).

Figure 5:
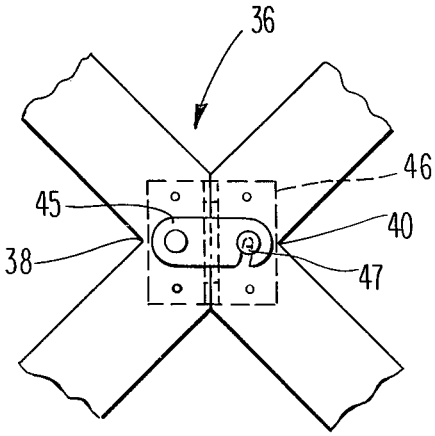
FIG. 5 is a fragmentary elevation view of the back brace and locking mechanism employed to interconnect and brace the rear legs.

Referring to FIGS. 1 and 5, the rear legs 18 are provided with a rear brace 36 formed by inwardly facing, substantially V-shaped brace member 38 and 40. The legs of each V-shaped brace member are hinged at their free ends to their adjacent rear legs, and the apices of the brace members confront each other, and are connected through a hinge member 46 located generally centrally between the rear legs on the outside of the brace. The rear brace members 38 and 40 are hinged to the respective rear legs in a manner to permit them to fold inwardly, as indicated by arrow 48 (FIG. 3). Likewise the hinge 46 is designed to permit the brace members to fold inwardly. However, a cooperable latch 45 and pin 47 are provided on the inside of brace members 38 and 40 to maintain the rear brace 36 in opened condition when the ladder 10 is to be used.

The provision of hinged sectional steps 14 between the laterally spaced-apart side rails 12, and the hinged rear brace between the laterally spaced-apart legs 18, permit the ladder to be collapsed laterally. Specifically, this is achieved by actually moving the front side rails 12 adjacent to each other, and by moving the rear legs 18 adjacent to each other. In the preferred arrangement this is accomplished by pivoting all of the steps upwardly, as indicated by arrows 49 in FIG. 1.

Figure 3A:
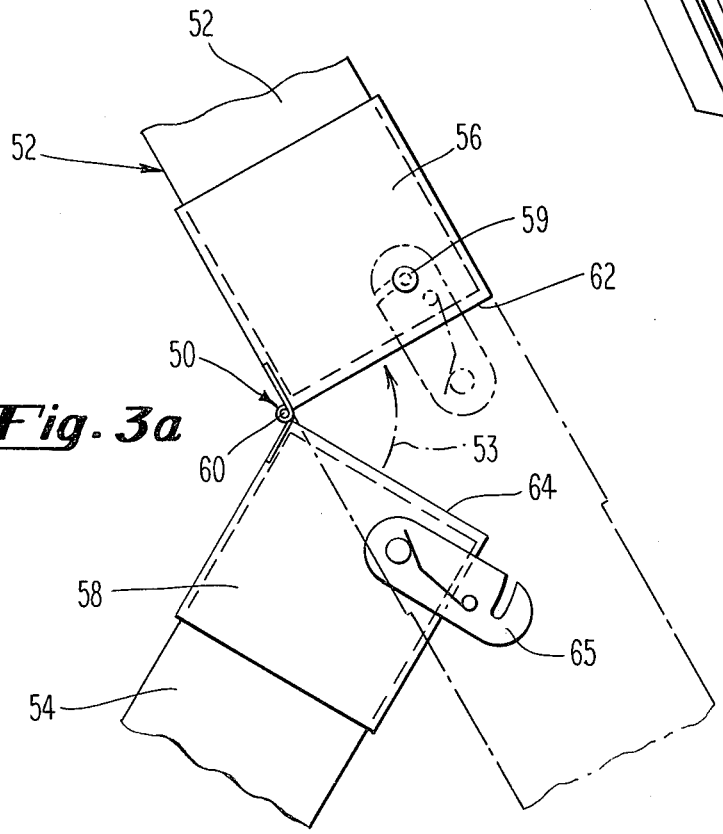
FIG. 3*a* is a fragmentary side view of the intermediate hinge section of one of the vertical side rails showing a partially collapsed orientation in solid representation, and a fully opened orientation in phantom representation.

Referring to FIGS. 1, 3 and 3*a*, each of the side rails 12 includes an intermediate hinge section 50 joining upper and lower side rail members 52 and 54. The hinged section 50 includes opposed members 56 and 58 hinged together by a pivot pin 60. The opposed members 56 and 58 are welded, or otherwise attached or secured to the upper and lower rail members 52 and 54, respectively. The opposed members 56 and 58 of the hinge section 50 include confronting surfaces 62 and 64, respectively. These surfaces will engage each other when the upper and lower rail members 52 and 54 are aligned to form a substantially linear side rail 12. Pivotal movement between the upper and lower rail members 52 and 54, in the direction of arrow 53 (FIG. 3*a*), cannot take place beyond this point. However, pivotal movement in the opposite direction can take place, and will permit the lower rail member 54 to be moved adjacent to and into engagement with the upper rail member 52. Thus, the hinge section 50 permits vertical collapsing of each of the side rails 12 only by the inward arcuate movement of the lower rail member 54 relative to the upper rail member 52. Outward arcuate movement is precluded by engagement of the confronting surfaces 62 and 64 of the hinge members 56 and 58. A latching member of hook 65, spring loaded by spring 67, is pivotally secured to the hinge member 58 for automatically snapping into locking engagement behind the head-end of pins 59 secured to the opposed hinge member 56. In this manner the side rail 12 will be locked in its opened condition, as illustrated in solid representation in FIG. 3, and phantom representation in FIG. 3*a*.

It should be understood that each intermediate hinge section 66 joining the upper and lower members 68 and 70 of each rear supporting leg 18 can be identical to the hinge section 50 of each side rail 12.

Figure 4:
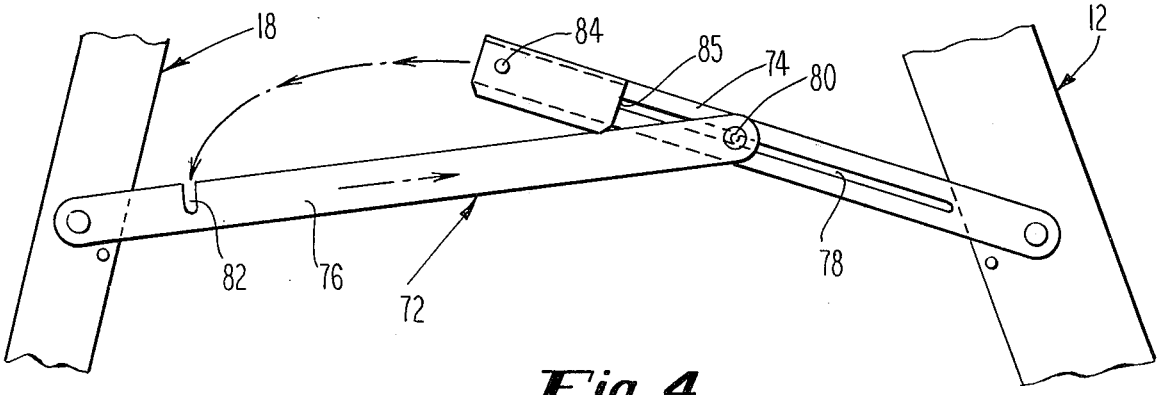
FIG. 4 is a fragmentary side elevation view showing a side brace employed to connect a front rail to a rear leg in accordance with this invention.

Referring to FIGS. 2–4, a unique arrangment of elements for permitting the ladder to be vertically collapsed will now be described. Note that the vertical collapsing of the ladder takes place by folding the lower side rail members 54 and lower leg members 70 inwardly, toward each other, as is shown in phantom in FIG. 3. To permit the lower rail members 54 and lower leg sections 70 to be fully collapsed adjacent their upper rail and leg members 52 and 68, respectively, it is necessary that sufficient clearance be established between the front rails and rear legs to provide for the required arcuate movement of the lower rail members 54 and lower leg members 70. However, the required clearance between the front rails and rear legs may be greatly in excess of the spacing necessary to provide firm support for the ladder when it is intended to be used. Therefore, if the ladder were maintained in its excessively spread condition during use, the overall height would be unnecessarily diminished.

The present invention includes unique side braces 72 which permit the side rails 12 and the rear legs 18 to be spread apart a sufficient distance to accommodate the vertical collapsability of these rails and legs by folding. At the same time these side braces permit the spacing between the legs and rails to be reduced when the ladder is intended to be utilized. It is understood that in the preferred embodiment two side braces 72 are employed; one for each side of the ladder. However, in some embodiments it may be possible to utilize only a single side brace between one of the side rails and its adjacent rear leg.

Referring to FIG. 4, a preferred side brace 72 is shown. This brace includes two links 74 and 76 hinged, or connected together through the cooperation of an elongate slot 78 in the link 74 and a pin 80 passing through the slot and connected to the link 76. Movement of the links 74 and 76 relative to each other into a substantially horizontal position, with the pin 80 adjacent end 85 of the slot 78, provides sufficient clearance between the side rails 12 and rear legs 18 to permit the rails and legs to be folded, i.e. vertically collapsed, without interfering with each other. However, in order to properly position the side rails relative to the legs when the ladder is intended to be used, an arcuate slot 82 is provided into the upper surface of the link 76 for cooperating with a pin 84 at the end of the link 74 to firmly lock the links 74 and 76 against relative movement. In this condition the side rails 12 and legs 18 are spaced-apart the desired distance for stabilizing the ladder; without excessivley reducing the height thereof. Note that the links 74 and 76 of each brace 72 also are pivotally connected to the side rail 12 and the rear leg 18, respectively. This permits the rear legs 18 to be moved into close proximity to the side rails 12 to thereby close the ladder (FIG. 2).

Figure 4A:
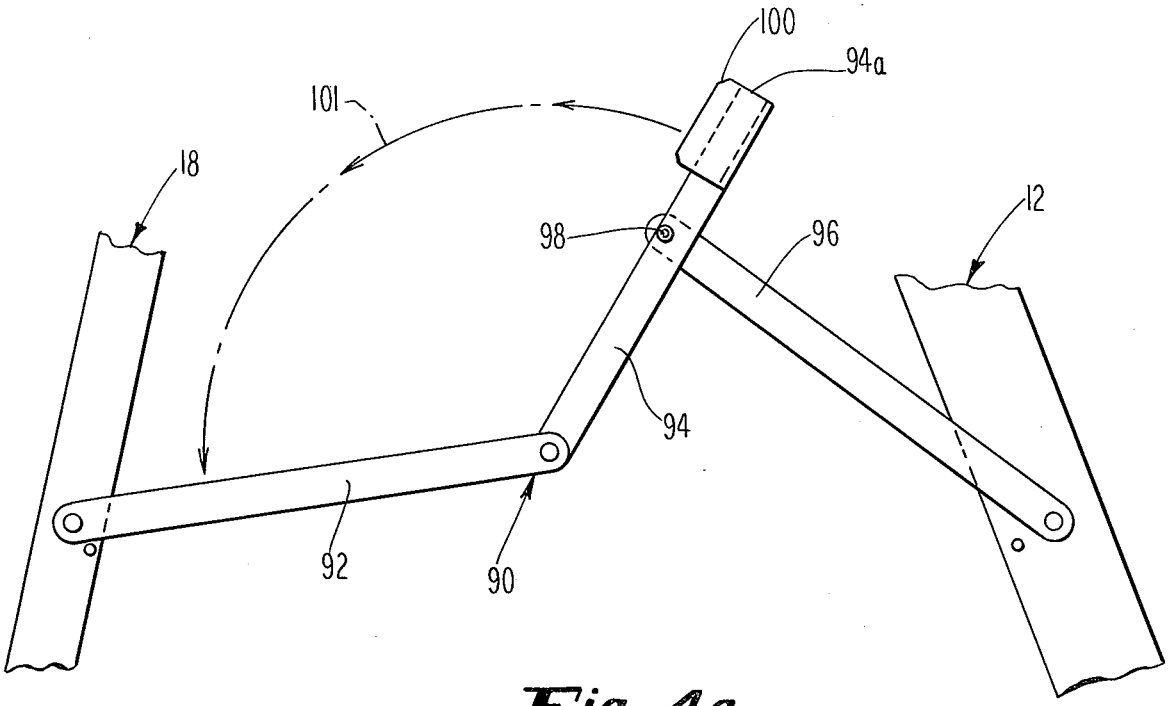
FIG. 4*a* illustrates an alternative construction of a side brace.

Referring to FIG. 4*a*, an alternative side brace 90 is disclosed. Again, it is understood that in the preferred embodiment two side braces are employed, one for each side of the ladder. However, it may be possible, in some embodiments, to utilize only a single side brace between one of the side rails 12 and its adjacent rear leg 18.

The side brace 90 is formed of three links 92, 94 and 96 hinged to each other. Ends of the outer links 92 and 96 also are hinged respectively to a rear leg 18 and an adjacent side rail 12. The opposite end of the link 96 is hinged at 98 inwardly from the free end 94*a* of the middle link 94. The link 94 includes a locking member 100 designed to overlie the link 92; when the link 94 is moved in the direction of arrow 101, to establish the desired spacing between the side rails 12 and rear legs 18 when the ladder is intended to be used. When the intermediate link 94 is moved in its opposite direction, it can fully extend the linkage system to thereby provide the requisite clearance between the side rails and rear legs to permit said rails and legs to be vertically folded without interfering with each other. The pivotal connection of the end links 92 and 96 of each brace 90 to the rear leg 18 and side rail 12, respectively, permits the rear legs to be moved closely adjacent the front side rails 12 to thereby close the ladder.

Referring to FIG. 2, the unique cooperation between a storage container 102 and the fully collapsed ladder 10 will be described. It should be noted here that the storage container 102 also doubles as a support platform that can be connected to the ladder to support tools, paints, etc., when the ladder is in use, as will be explained in detail hereinafter.

Referring to FIG. 2, the storage container 102 includes front and rear walls 104 and 106, respectively, and the rear wall 106 extends above, or higher than the front wall 104. As will be explained hereinafter, the surface of the rear wall extending beyond the upper edge of the front wall 106 constitutes an article-supporting surface when the container is employed as a support platform attached to the ladder.

The container also includes sidewalls 108 and 110, which have a shorter transverse dimension than the front and rear walls, and a bottom wall 112 completing the formation of the compartment into which the bottom, or lower end of the ladder 10 is inserted. Note in FIG. 2 that the lateral dimension of the compartment (i.e. the distance between the sidewalls 108 and 110) is slightly greater than the distance between the outer surfaces of the upper rail members 52 and upper rear leg members 68 when the ladder 10 is completely collapsed.

As was pointed out earlier in this application, when the ladder is laterally collapsed, all of the steps are pivoted in an upward direction. However, when the lower rail members 54 are vertically collapsed, by being folded upwardly adjacent the upper rail members 52, the step 14 connected to the lower rail member 54 adjacent hinge 50 will be inverted. This results in a portion of that step, indicated as 14' in FIG. 2, extending downwardly below the surfaces 62 and 64 of the hinge members 56 and 58, respectively. To protect the step 14' from being damaged a pair of spaced-apart partitions 114 and 116 extend upwardly from the bottom wall 112 of the storage container for contacting lower surfaces of the completely collapsed ladder on each side of the downwardly directed step 14', with said step 14' being spaced from the bottom wall 112. Thus, the downwardly directed step 14' is supported in space, and is thereby effectively protected against damage.

As shown in FIGS. 1 and **1*b*, the storage container 102 can double as an article-supporting platform when the ladder is in use. To this end laterally spaced-apart elongate slots 120 are provided in the front wall 104 of the container. These slots extend rearwardly to the bottom wall 112, whereat they terminate in enlarged generally L-shaped openings 122** extending through the bottom wall.

A pair of laterally spaced-apart substantially L-shaped downturned tabs 124 extend downwardly from elongate edges of the elongate openings 34, and the legs **124*a* of these tabs face each other. Referring to FIG. 1*b*, the L-shaped tabs 124 initially are received within the laterally enlarged openings 122 in the bottom wall 112. Thereafter, rearward movement of the storage container, as indicated by the arrow in FIG. 1, will cause each tab 124 to move into narrower slot 120 so that a surface of leg 124*a* will engage the inner surface of the front wall 104. In this manner the storage container is releasably connected to the ladder, with the surface of the rear wall 106 that extends beyond the front wall 104 constituting an exposed article-supporting surface. Also, the downward moment created by the articles supported on the rear wall 106 will be counteracted by engagement of the front wall 104 with the lower surface of the top platform 16. It should be noted that the front wall 104 of the container, when fully assembled with the ladder, also completely closes, or overlaps the elongate openings 34 in the platform 16** to thereby prevent any items placed on the platform from falling through these openings.

It should be understood that other arrangements can be employed to releasably connect the storage container 102 to the ladder. For example, referring to FIG. **1*c*, the downturned tabs 124 could be replaced with laterally spaced-apart pins 125 extending downwardly from the underside of the top platform 16, and being provided with enlarged heads. These enlarged heads can then be received within enlarged openings 122 in the bottom wall 112. Thereafter, when the storage container 102 is moved rearward, as indicated by the arrow in FIG. 1, the enlarged head of each pin 125 will move into the narrower slot 120 for engaging the inner surface 127 of the front wall 104. As an alternate arrangement, the sidewalls 108 and 110 could be provided with elongate openings that cooperate with inwardly directed pins connected to the rear legs and front rails. If desired the elongate slots in the sidewalls 108 and 110 could communicate with enlarged openings provided in the bottom wall 112, and the inwardly directed pins could be provided with enlarged heads adapted to be received within the enlarged opening in the bottom wall, and then directed along the elongate slot within the sidewalls 108 and 110**.

Although the preferred embodiments of this invention have been described above, it is understood that other modifications and alterations may be made within the scope of this invention. Therefore, reference should be had to the claims appended hereto for determining the scope of this invention.

Having described our invention, we claim:

1. A foldable ladder of the type having laterally spaced-apart, substantially vertically oriented front side rails joined by a plurality of steps, and substantially vertically oriented rear support means, said side rails and rear support means being movable away from each other into an open position, when said ladder is to be used, and being movable toward each other into a closed position, when said ladder is to be stored, each of said steps being hinged for permitting lateral collapsing of said ladder by movement of said laterally spaced-apart side rails toward each other, said side rails and rear support means including hinge means intermediate vertical ends thereof for permitting vertical collapsing of the ladder by the folding of the side rails and rear support means about said intermediate hinge means, characterized in that a sectional upper platform is joined to upper ends of the side rails and rear support means and is hinged intermediate its lateral ends for permitting lateral collapsing of said upper platform by movement of said laterally spaced-apart side rails toward each other, said upper platform including openings on opposite sides of the intermediate hinged connection, said openings being positioned to be in lateral alignment when the upper platform is laterally collapsed to thereby provide a carrying handle.

2. The foldable ladder of claim 1 in combination with an article-supporting member, characterized by cooperable attachment means on the member and adjacent the upper platform for permitting the member to be removably attached to the ladder with a surface of said member underlying the openings through said upper platform.

3. A foldable ladder of the type having laterally spaced-apart, substantially vertically oriented front side rails joined by a plurality of steps, and substantially vertically oriented rear support means, said side rails and rear support means being movable away from each other into an open position, when said ladder is to be used, and being movable toward each other into a closed position, when said ladder is to be stored, said side rails and rear support means including hinge means intermediate vertical ends thereof for permitting vertical collapsing of the ladder by the folding of the side rails and rear support means about said intermediate hinge means, each of said steps being hinged for permitting lateral collapsing of said ladder by movement of the laterally spaced-apart side rails toward each other, characterized by the addition of a storage container for said ladder after said ladder has been vertically and laterally collapsed, said container having a bottom wall joined to upstanding peripheral front, rear and side walls to form a compartment, opened at the top thereof, for receiving the lower end of said ladder.

4. The foldable ladder and storage container of claim 3, wherein a portion of one step constitutes the lowermost section of the ladder after said ladder has been vertically and laterally collapsed, characterized in that the container includes spaced-apart partitions above the bottom wall of said compartment for engaging and supporting the ladder with said portion of said one step disposed between said spaced-apart partitions and out of engagement with the bottom wall of said compartment.

5. The foldable ladder and storage container of claim 3, characterized by cooperable attachment means on the container and adjacent the top of the ladder for permitting the container to be removably attached to said ladder with the front and rear walls of said container being substantially in a horizontal plane.

6. The foldable ladder and storage container of claim 5, characterized in that one of said front and rear walls extend outwardly beyond the other to provide an article-supporting surface when the container is removably attached to said ladder.

7. A foldable ladder of the type having laterally spaced-apart, substantially vertically oriented front side rails and laterally spaced-apart, substantially vertically oriented rear supporting legs, a plurality of steps being joined to the laterally spaced-apart front side rails and an upper platform being joined to upper ends of the laterally spaced-apart front side rails and rear supporting legs, said side rails and rear supporting legs being movable away from each other into an opened position, when said ladder is to be used, and being movable toward each other into a closed position, when said ladder is to be stored, said side rails and rear supporting legs including hinge means intermediate vertical ends thereof for permitting vertical collapsing of the ladder by the folding of the side rails and rear supporting legs about said intermediate hinge means, each of said steps and said upper platform being hinged for permitting lateral collapsing of said ladder by movement of said laterally spaced-apart side rails and rear supporting legs toward each other, characterized in that a side brace means connects at least one side front rail to an adjacent rear leg when the ladder is both laterally collapsed and when the ladder is opened for use, said brace means including interconnected links movable relative to each other from an opened position, in which the rear legs are spaced farther apart from the front side rails than when the ladder is intended to be used for the purpose of permitting the vertical collapsing of the ladder by the folding of the side rails and rear supporting legs about their intermediate hinge means, to a contracted position, in which the rear legs are closely adjacent the front side rails for storage of the ladder.

8. The foldable ladder of claim 7, characterized in that interconnected links of the side brace means include cooperable locking means for preventing relative movement of the interconnected links when said links are intermediate said fully opened position and said contracted position.

9. The foldable ladder of claim 8, characterized in that said side brace means is provided to connect each side front rail to an adjacent rear leg.

10. A foldable ladder of the type having laterally spaced-apart, substantially vertically oriented front side rails joined by a plurality of steps, and laterally spaced-apart, substantially vertically oriented rear supporting legs, said side rails and rear supporting legs being movable away from each other into an open position, when said ladder is to be used, and being movable toward each other into a closed position, when said ladder is to be stored, said ladder further including an upper platform having sections overlying upper ends of the rear legs and front rails, characterized in that said legs and rails include elongate channels and said platform sections include downwardly directed tabs engageable within the channels when the ladder is opened for use to thereby aid in stabilizing said ladder.

* * * * *